US005588534A

United States Patent [19]

Harel

[11] Patent Number: 5,588,534

[45] Date of Patent: Dec. 31, 1996

[54] GARBAGE SEPARATOR SYSTEM

[76] Inventor: Denis Harel, 2160 Blvd. Lafleche, Baie Comeau, Quebec, Canada, G5C 1E3

[21] Appl. No.: 315,441

[22] Filed: Sep. 30, 1994

[51] Int. Cl.[6] ..... B07C 5/02

[52] U.S. Cl. ..... 209/3.1; 209/44.1; 209/636; 209/692; 209/930

[58] Field of Search ..... 209/2, 3, 3.1, 44.1, 209/12.1, 636, 691, 692, 930

[56] References Cited

U.S. PATENT DOCUMENTS

| | | | |
|---|---|---|---|
| 3,330,410 | 7/1967 | Kirk | 209/692 |
| 3,722,673 | 3/1973 | Bedwell et al. | 209/692 |
| 3,888,351 | 6/1975 | Wilson | 209/930 X |
| 4,267,930 | 5/1981 | Melkonian et al. | 209/692 X |
| 4,929,342 | 5/1990 | Johnston | 209/930 X |
| 5,267,823 | 12/1993 | Roman | 209/930 X |
| 5,333,738 | 8/1994 | Fuchs et al. | 209/692 X |

FOREIGN PATENT DOCUMENTS

| | | | |
|---|---|---|---|
| 3607787 | 8/1987 | Germany | 209/692 |

*Primary Examiner*—David H. Bollinger
*Attorney, Agent, or Firm*—Eric Fincham

[57] ABSTRACT

There is provided a method and apparatus for processing domestic garbage wherein the garbage is debagged and placed on a series of vibrating conveyors which are tilted with respect to the horizontal in a direction substantially normal to the direction of conveyor operation whereby the garbage is separated according to the density/hardness of the material. The apparatus can include various accessory devices including electro magnets, vacuum devices and blowing devices to assist in the separation of the material.

11 Claims, 2 Drawing Sheets

GARBAGE SEPARATOR SYSTEM

BACKGROUND OF THE INVENTION

The present invention relates to an apparatus and method and more particularly, relates to an apparatus for separating garbage and a method for separating various types of garbage.

Present day ecological concerns have meant that a great deal of work is being done on reducing the volume of waste. The method of treating domestic waste or garbage has not changed substantially in a number of years and still most of the garbage from the residence is placed in garbage bags from where it is picked up by garbage contractors from where it is subsequently hauled off to land fill sites. The availability of such sites convenient to major urban areas has decreased and as a result, it has become increasingly expensive and difficult to dispose of much of the domestic garbage.

In order to assist in obviating this problem, efforts have been made to recycle as large a portion of the garbage as possible. This, in combination with other methods such as composting have helped to reduce the total volume. However, it is still recognized that larger quantities of domestic garbage are disposed of than would be required if a greater degree of recycling were practiced. However, this has become difficult as it requires an education process and there are always a certain number of places where it is difficult and/or impractical to recycle.

As a result, domestic or residential garbage (and this can include commercial garbage) still has a large volume of material susceptible to recycling. Obviously, it would be desirable to achieve as high a percentage of recycled goods as possible in order to minimize the ultimate disposal problems and to lessen the demand on our resources.

SUMMARY OF THE INVENTION

It is an object of the present invention to provide an apparatus for the processing of garbage wherein the apparatus is adapted to separate recyclable materials into different categories.

It is a further object of the present invention to provide an apparatus for separating domestic garbage wherein vibrating conveyors are utilized to separate domestic waste into different categories.

It is a further object of the present invention to provide a method for the separating of domestic garbage into different categories.

According to one aspect of the present invention, there is provided a garbage separating apparatus which includes at least first and second conveyors, with each conveyor having an input end and a discharge end. The conveyors are arranged such that materials discharged from a side of the first conveyor will be deposited on the second conveyor. Each conveyor is tilted with respect to the horizontal in a direction substantially normal to the direction of conveyor operation to thereby permit the side discharge. Vibrating means are operatively associated with each of the conveyors to impart a vibratory movement thereto. There are also provided means for feeding material to the input end of the first conveyor.

In a further aspect of the present invention, there is provided a method for separating domestic garbage, the method including the steps of providing at least first and second conveyors, each conveyor having an input end and a discharge end, with the conveyors being arranged such that material discharged from a side of the first conveyor will be deposited on the second conveyor, tilting each conveyor with respect to the horizontal in a direction substantially normal to the direction of conveyor operation, vibrating each of the conveyors while material is thereon, and controlling the conveyor speed, vibration and tilting to thereby separate different categories of materials.

In greater detail, the arrangement of the conveyors with respect to each, as above mentioned, is such that material discharged from the side of the first container will be directed to a second conveyor. It will be understood that various different arrangements are possible including the use of a substantial number of conveyors stacked in a vertical or horizontal mode.

In one embodiment, the apparatus of the present invention may utilize conveyors which are mounted in a side by side relationship. Each of the conveyors is preferably of the belt type of conveyor which has a continuous belt entrained above one or more support rollers or like means along with means for driving the belt. Each conveyor will therefore have a discharge end and an input end. Belt conveyors are well known in the art and need not be described herein. It suffices to say that the "belt" may be formed of different material selected from those well known in the art. For example, various rubberized and/or plastic materials could be utilized and the belt could be formed of an impervious material of alternatively, could be of the mesh type to permit selected materials to pass therethrough.

As aforementioned, each conveyor is "tilted" or has its upper material transporting surface inclined with respect to the horizontal in a direction transverse to the direction of travel of the conveyor. The degree or amount of tiling of the conveyor of tilting will vary depending upon several parameters. One of the most important factors is the amount of time it will take for a given category of material to discharge from the side of the conveyor prior to discharge from the end of the conveyor and this would be a function of conveyor speed, the degree of tilting of the conveyor, the amount of vibration imparted thereto, the conveyor surface, etc. Needless to say, the degree of tilt can be varied depending upon the desired results. To this end, preferably there are provided means for varying the degree of tilt according to the desired results.

As aforementioned, vibrating means are provided to impart vibration to the upper material carrying surface of the conveyor. Such means are well known in the art and vibrating means may be provided which function to vibrate all conveyors or alternatively, each conveyor may be provided with its own vibrating means.

The separation of the material, as aforementioned, will depend on a number of parameters including the vibrating force, the angle of the conveyor, the conveyor speed, etc. To assist in providing maximum flexibility for operation of the device, there may be provided means for controlling the discharge such as diverter gates which are moveable into and out of desired positions. Thus, the diverter gates may be operated so as to either prevent or permit discharge of certain materials from the conveyor side near the discharge end. In other words, an operator would be able to control to a certain extent the degree of separation of the materials on the conveyor belt.

The residential garbage, as it comes in, is frequently stored in bags and in particular, the use of plastic bags is wide spread. In order to effectively separate the garbage therein, it needs to be removed from the bags and to this end, means may be provided to effectively tear or rip open the bags in order that the contents thereof may be separated. In one embodiment, a plurality of moving hooks may be employed to assist in the removal of the contents from the bags. In conjunction with this, there may be provided means for removing the plastic material forming the bag and to this end, a suitable source of vacuum may be applied at the point where the bags are ripped open. The plastic material would then be collected for recycling.

The invention can also include magnetic means for removing all ferrous materials. Thus, a suitable electro magnet may be utilized to remove ferrous material such as cans and the like.

In conjunction with the above, various supplemental means may be incorporated to aid in the separation of the materials. Thus, the use of air currents through several fans or compressed air may assist in separating the material as will be discussed in greater detail hereinbelow.

Having thus generally described the invention, reference will be made to the accompanying drawings illustrating an embodiment thereof, in which:

DETAILED DESCRIPTION OF THE INVENTION

Figure 1:
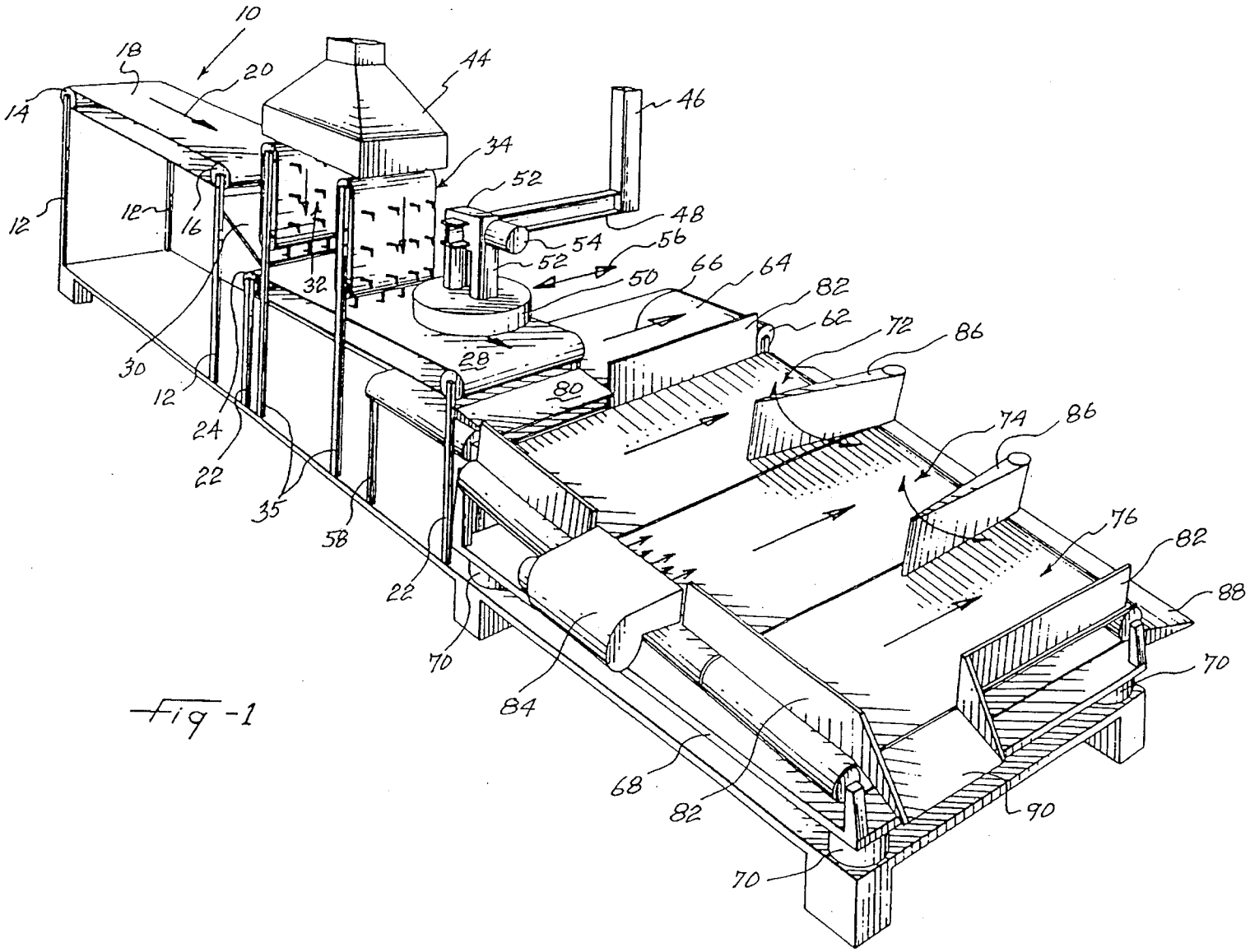
FIG. 1 is a perspective view of an apparatus for use in the separation of garbage.

Referring to the drawings in greater detail and by reference characters thereto, the apparatus of the present invention includes a first conveyor assembly which includes a plurality of vertical frame members 12 adapted to receive rolls 14 and 16 which are rotatably journalled thereon. A conveyor belt 18 extends around rolls 14 and 16 and is driven by suitable means (not shown) in the direction indicated by arrow 20.

A further conveyor assembly includes vertical supports 22 connected to rotatably receive rolls 24 and 26 which in turn have a conveyor belt 28 entrained thereabout. Again, suitable drive means (not shown) are provided. A ramp 30 extends from the discharge end of conveyor belt 18 to the input end of conveyor belt 28.

A pair of debagging devices are generally indicated by reference numerals 32 and 34 and are supported by vertical frame members 35. Both debagging devices 32 and 34 are similar and thus, only one will be described in detail herein.

Figure 2:
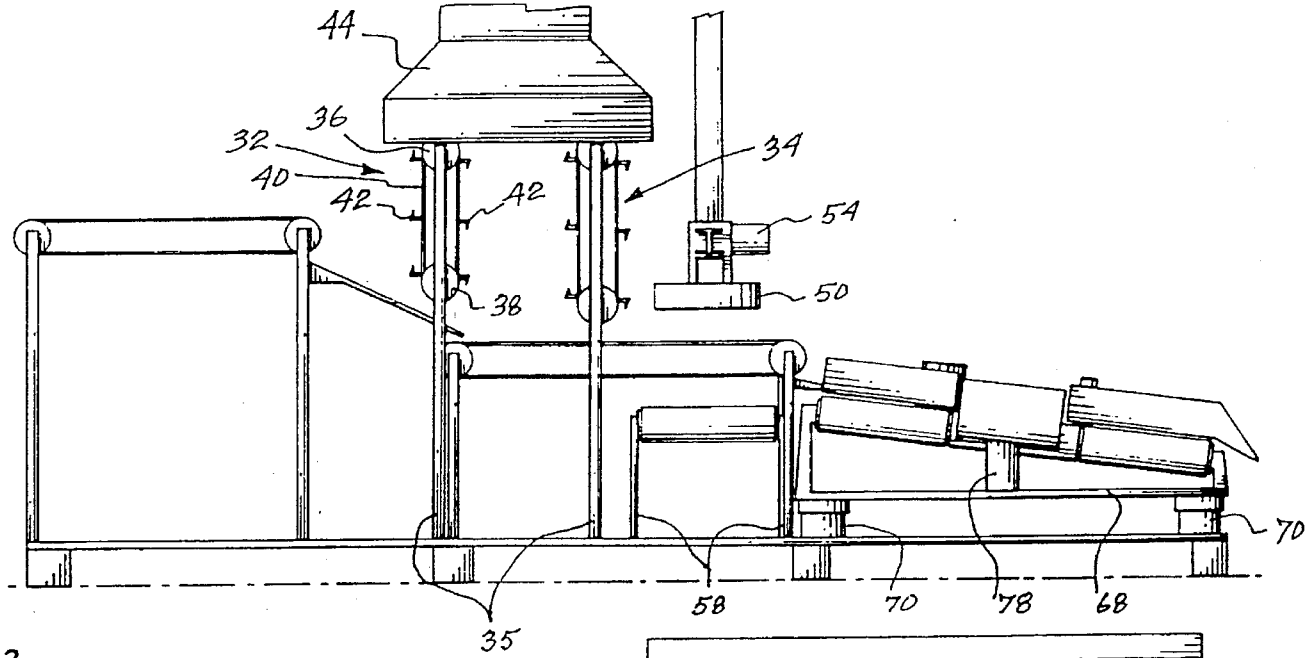
FIG. 2 is a side elevational view thereof.
Figure 3:
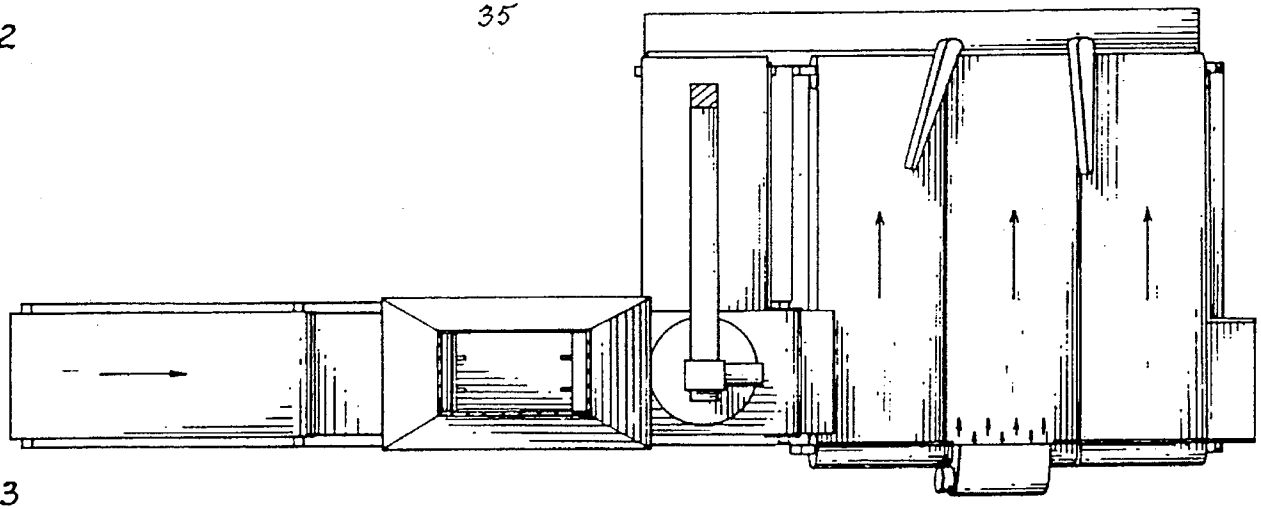
FIG. 3 is a top plan view thereof.

Debagging device 32, best illustrated in FIG. 2, includes a pair of rolls 36 and 38 having a belt or similar member 40 entrained thereabout. Attached to belt 40 are a plurality of hook shaped shredding members 42. Extending about both debagging devices 32 and 34 is a vacuum hood 44 connected to a suitable vacuum source.

Located near the discharge end of conveyor belt 28 is a vertical frame member 46 having an I beam 48 suitably secured thereto. An electro-magnet 50 is mounted on a suitable sub-frame 52 which in turn is moveable horizontally along I beam 48 through means of a suitable drive motor 54. Thus, sub assembly 52 carrying electro magnet 50 is reciprocally moveable as indicated by arrow 56.

Vertical frame members 58 support a further conveyor assembly which includes rolls 60 and 62 and which have a conveyor belt 64 entrained thereabout. Suitable drive means (not shown) drive conveyor belt 64 in the direction indicated by arrow 66.

The apparatus includes, as shown in FIG. 1, a sub frame 68 which is mounted on main frame F through means of a plurality of vibrating assembles 70. Sub frame 68 in turn has mounted thereon three conveyors generally designated by reference numerals 72, 74 and 76 in a side by side relationship. Each of conveyors 72, 74 and 76 is mounted and driven in a conventional manner and will not be described in greater detail herein. It suffices to say that means of mounting such conveyors on suitably driven rolls is well known as is the case with the previously described conveyors. Conveyors 72, 74 and 76 are driven in identical directions as indicated by the arrows. As will be noted, the conveyors are tilted with respect to the horizontal and to this end, a suitable height adjusting device 78 such as a hydraulic cylinder may be provided.

A ramp 80 is provided at the discharge end of conveyor belt 28 and as will be seen from FIG. 1, a plurality of guide plates 82 are provided at the ends and sides of the conveyor as required.

Located proximate the input end of conveyor 74 is a fan 84 adapted to blow a gaseous material such as air. Between the discharge ends of conveyors 72, 74 and 74, 76 are adjustable guide plates 86 which are pivotably moveable as indicated by the arrows to thereby control discharge of the material on the conveyors.

A discharge ramp 88 is adapted to guide material from conveyors 72, 74 and 76 while a further discharge ramp 90 is provided at the input end of conveyor 76.

In operation, the refuse is initially delivered to conveyor assembly 10 where it is transported by conveyor belt 20 and discharged to ramp 30 and from there to the input end of conveyor belt 28. At this point in time, operation of debagging devices 32 and 34 functions to tear or rip open bags; the conveyor belts are driven such that hooks 42 would engage and tear the bags. Operation of debagging devices 32 and 34 tends to cause the plastic bags themselves to be shredded to a degree such that a vacuum applied through vacuum hood 44 would remove the plastic pieces from hooks 42.

Subsequently, the debagged refuse would continue along conveyor belt 28 and pass underneath electro-magnet 50 wherein any ferrous material is removed. Periodically motor 54 is operated to drive sub frame 52 along I beam 48. Cutting of current to electro magnet 50 would then cause the metallic material to fall on conveyor belt 64 for discharge.

The remaining material, after discharging from conveyor belt 28, is transferred by way of ramp 80 to first conveyor belt 72. Conveyor belts 72, 74 and 76 are vibrating through operation of vibrators 70 while at the same time the conveyor belts are operating in the directions indicated by the arrows. As a result, relatively dense or hard material will tend to move sideways while relatively soft material such as various foods and wet paper would tend to remain on the belt for discharge from discharge end of conveyor 72 through ramp 88. Other materials such as plastic bottles and other denser/harder objects would tend to pass on to second conveyor 74. At this point in time, the operation of fan 84 would tend to separate cartons, boxes, etc. which would be discharged from conveyor 74 into a suitable container.

Meanwhile, objects such as bottles and the like would tend to move fairly quickly to be discharged through exit 90 while remaining material would pass on to conveyor 76 which would tend to contain plastic objects and the like.

As will be seen from the above, there are various operating parameters which can be controlled to maximize the effectiveness of the system. Thus, the degree of tilt of the conveyor may be varied as well as the speed of the conveyors. Also, as is known in the art, the vibrator could be controlled to vary the frequency/force of the vibration. Adjustable guides 86 would also be operator controlled to provide the required degree of separation of the material.

It will also be understood that the arrangement of the conveyors can be varied. In the illustrated embodiment, three such vibrating conveyors are illustrated in a side by side relationship. This could be varied by, for example, having the conveyors stacked one above the other with suitable guide chutes being provided to direct material discharged from the side to the other conveyor. Furthermore, it will be understood that additional conveyors can be used and the material subjected to further separation. For example, one would be able to take the material discharged from the end of one conveyor and input it to a further series of conveyors to achieve the desired degree of separation.

It will be understood that the above described embodiment is for purposes of illustration only and changes and modifications may be made thereto without departing from the spirit and scope of the invention.

What is claimed is:

1. A garbage separating apparatus comprising at least first and second conveyors, each of said conveyors having an input end and a discharge end, said conveyors being arranged such that material discharged from a side of said first conveyor will be deposited on said second conveyor, each conveyor being tilted with respect to the horizontal in a direction substantially normal to the direction of conveyor operation, vibrating means operatively associated with each of said conveyors to impart a vibratory movement thereto, and means for feeding material to the input end of said first conveyor.

2. The apparatus of claim 1 wherein said first and second conveyor are mounted in a side by side relationship.

3. The apparatus of claim 1 further including debagging means adapted to tear open bags of garbage.

4. The apparatus of claim 1 further including magnetic means adapted to remove ferrous material.

5. The apparatus of claim 1 further including means for adjustably tilting each of said conveyors.

6. The apparatus of claim 1 further including a third conveyor mounted in a side by side relationship with said first and second conveyors.

7. The apparatus of claim 1 wherein said means for feeding material to the input end of said first conveyor comprises a feed conveyor.

8. The apparatus of claim 1 further including blower means associated with one of said conveyers, said blower means being directed to blow lighter objects in the direction of conveyer operation.

9. A method for separating domestic garbage, the method comprising the steps of providing at least first and second conveyors, each of said conveyors having an input end and a discharge end, said conveyors being arranged such that material discharged from the side of said first conveyor will be deposited on said second conveyor, tilting each conveyor with respect to the horizontal in a direction substantially normal to the direction of conveyor operation, operating said conveyor to take material from said first end to said second end, vibrating each of said conveyors while said material is thereon, and controlling the conveyor speed, vibration and tilting to thereby separate different types of material from each other.

10. A garbage separating apparatus comprising an input station for receiving garbage, debagging means adapted to tear open bags of garbage, vacuum means operatively associated with said debagging means to remove said bags after said debagging means tear open said bags, released first and second conveyers to receive said garbage after said debagging means, each of said conveyers having an input end an a discharge end, said conveyers being arranged such that material discharge from a side of said first conveyer will be deposited on said second conveyer, each conveyer being tilted with respect to the horizontal in a direction substantially normal to the direction of conveyer operation, vibrating means operatively associated with each of said conveyers to impart a vibratory movement thereto, and means for feeding material to the input end of said first conveyer.

11. A garbage separating apparatus comprising first and second conveyers, each of said conveyers having an input end an a discharge end, said conveyers being arranged such that material discharged from a side of said first conveyer will be deposited on said second conveyer, each conveyer being tilted with respect to the horizontal in a direction substantially normal to the direction of conveyer operation, vibrating means operatively associated with each of said conveyers to impart a vibratory movement thereto, adjustable divertor gate situated at the discharge end of said conveyers, and means for feeding material to the input end of said first conveyer.

* * * * *